US005531281A

United States Patent [19]

Murdock

[11] Patent Number: 5,531,281

[45] Date of Patent: Jul. 2, 1996

[54] ROTARY DRILLING TOOLS

[75] Inventor: Andrew D. Murdock, Stroud, England

[73] Assignee: Camco Drilling Group Ltd., Stonehouse, England

[21] Appl. No.: 275,145

[22] Filed: Jul. 14, 1994

[30] Foreign Application Priority Data

Jul. 16, 1993 [GB] United Kingdom ..... 9314954

[51] Int. Cl.[6] ..... E21B 10/46

[52] U.S. Cl. ..... 175/431

[58] Field of Search ..... 175/431, 428, 175/430, 432

[56] References Cited

U.S. PATENT DOCUMENTS

| | | | |
|---|---|---|---|
| 4,471,845 | 9/1984 | Jurgens | 175/431 |
| 4,499,958 | 2/1985 | Radtke et al. | 175/428 |
| 4,718,505 | 1/1988 | Fuller | 175/428 |
| 5,238,075 | 8/1993 | Keith et al. | 175/431 |
| 5,265,685 | 11/1993 | Keith et al. | 175/431 |

FOREIGN PATENT DOCUMENTS

| | | | |
|---|---|---|---|
| 0164297 | 2/1985 | European Pat. Off. | 175/431 |
| 1707179 | 1/1992 | U.S.S.R. | 175/431 |
| 2086451 | 5/1982 | United Kingdom | 175/431 |
| 9313290 | 12/1992 | WIPO . | |

OTHER PUBLICATIONS

Paper No. SPE/IADC 25734, by G. E. Weaver and R. I. Clayton Society Petroleum Engineers, SPE/IADC Conference Amserdam, Feb. 23–24, 1993.

*Primary Examiner*—Hoang C. Dang

[57] ABSTRACT

A rotary drilling tool has a plurality of cutters mounted on the tool body and formed with cutting edges defining a cutting profile. The cutters include at least two concentric arrays of primary preform polycrystalline diamond cutters which are radially spaced so as to define an annular groove in the cutting profile, between the two arrays. The deepest part of the groove in the cutting profile is defined by secondary preform polycrystalline diamond cutters located at a radial position which is intermediate the radial positions of the two arrays of primary cutters, so that in use the secondary cutters remove the tops of annular ridges of formation left between the arrays of primary cutters.

2 Claims, 4 Drawing Sheets

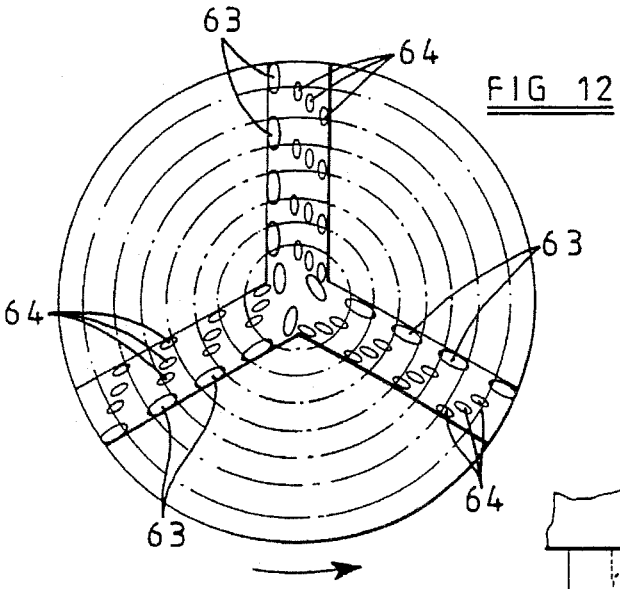
FIG 12
FIG 13
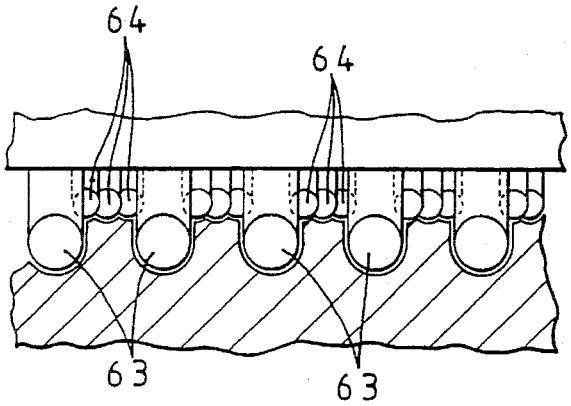
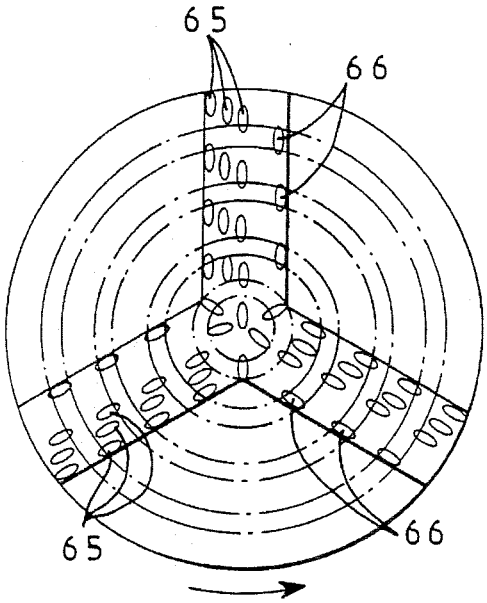
FIG 14
FIG 15
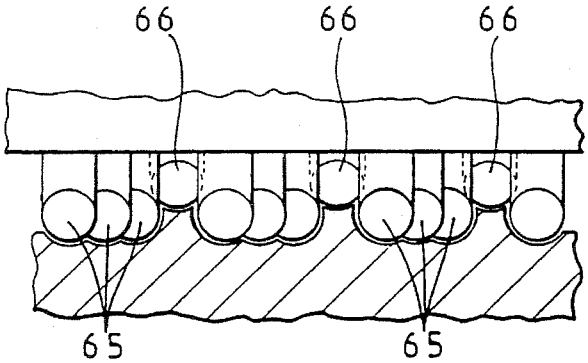

ROTARY DRILLING TOOLS

BACKGROUND OF THE INVENTION

The invention relates to rotary drilling tools, for use in drilling subsurface formations, of the kind comprising a tool body having a shank for connection to a drill string, and a plurality of cutters mounted on the tool body and formed with cutting edges defining a cutting profile.

The "cutting profile" of the drilling tool is an imaginary surface of revolution swept out by the cutting edges of the cutters as the tool rotates (with zero rate of penetration).

The invention is particularly, but not exclusively, applicable to drilling tools in which some or all of the cutters are preform (PDC) cutters each formed, at least in part, from polycrystalline diamond. One common form of cutter comprises a tablet, usually circular or part-circular, made up of a superhard table of polycrystalline diamond, providing the front cutting face of the element, bonded to a substrate which is usually of cemented tungsten carbide.

The tool body may be machined from solid metal, usually steel, or may be moulded using a powder metallurgy process in which tungsten carbide powder is infiltrated with metal alloy binder in a furnace so as to form a hard matrix.

The invention is particularly applicable to drill bits, and will be particularly described in relation thereto. However, it is to be understood that the invention is also applicable to other forms of drilling tools, such as hole openers and eccentric hole openers.

While PDC bits have been very successful in drilling relatively soft formations, they have been less successful in drilling harder formations and soft formations which include harder occlusions or stringers. Although good rates of penetration are possible in harder formations, the PDC cutters suffer accelerated wear and bit life can be too short to be commercially acceptable.

Studies have suggested that the rapid wear of PDC bits in harder formations is due to chipping of the cutters as a result of impact loads caused by vibration, and that the most harmful vibrations can be attributed to a phenomenon called "bit whirl". Bit whirl arises when the instantaneous axis of rotation of the bit precesses around the central axis of the hole when the diameter of the hole becomes slightly larger than the diameter of the bit. When a bit begins to whirl some cutters can be moving sideways or backwards relatively to the formation and may be moving at much greater velocity than if the bit were rotating truly. Once bit whirl has been initiated, it is difficult to stop since the forces resulting from the bit whirl, such as centrifugal forces, tend to reinforce the effect.

One method which has been employed to overcome bit whirl is to design the drill bit so that it has, when rotating, an inherent lateral imbalance force which is relatively constant in direction and magnitude. The gauge of the bit body then includes one or more low friction bearing pads which are so located as to transmit this lateral imbalance force to the part of the formation which the bearing pad is for the time being engaging. The low friction bearing pad thus tends to slide over the surface of the formation which it engages thereby reducing the tendency for bit whirl to be initiated.

In an alternative approach, bits have been designed in a manner to provide a structure which constrains the bit to rotate truly, i.e. with the axis of rotation of the bit coincident with the central axis of the borehole. One such approach is described in a paper titled "A new PDC cutting structure improves bit stabilisation and extends application into harder rock types", Paper No. SPE/IADC 25734 by G. E. Weaver and R. I. Clayton, Society of Petroleum Engineers, SPE/IADC Drilling Conference, Amsterdam, 23–25 Feb. 1993.

In PDC bits the cutters are normally arranged in spiral arrays with respect to the central axis of rotation of the bit so that the path swept by each cutter during each rotation overlaps the paths swept by other cutters disposed at slightly greater and slightly smaller radial distances from the bit axis. This provides an essentially smooth cutting profile to ensure that no part of the formation at the bottom of the borehole remains uncut. By contrast Weaver and Clayton proposed a cutter formation where the cutters, instead of being located in spiral formations, are disposed in concentric radially spaced arrays centred on the axis of rotation of the bit. In such an arrangement the cutters in each circular array sweep through essentially the same cutter path and the cutter paths of adjacent arrays do not overlap but are spaced apart in the radial direction. Consequently, the cutters define a series of concentric annular grooves in the cutting profile. As a result the cutters in each circular array cut a deep groove in the formation at the bottom of the borehole with annular ridges of uncut formation extending upwardly between the adjacent circular arrays of cutters.

The annular ridges increase significantly the vertical contact between the cutters and the formation so that any lateral force acting on the bit, whether externally generated or from cutting structure imbalance, is distributed over a larger contact area. This reduces the unit stress on the formation and the result of lower unit stress is said to result in less tendency for a cutter to bite laterally into the formation and initiate bit whirl.

However, such arrangements depend, in operation, on the upstanding annular ridges of formation between the cutter arrays eventually breaking off when they reach such a height that they cannot withstand even the lower unit lateral stress applied to them. In order to ensure that this occurs, it is necessary for the annular ridges to be of narrow radial width. It also means that the point at which an annular ridge breaks off may be unpredictable since it will depend on the nature of the formation in the ridge and the lateral force which happens to be applied to the ridge during drilling. If a ridge breaks off when it is comparatively low in height, it will not provide a useful contribution to inhibiting lateral displacement of the bit and inhibiting the initiation of bit whirl. On the other hand, if a ridge does not break off until it has reached a considerable axial depth, the ridge may bear on and abrade the surface of the bit body between the adjacent arrays of cutters, resulting in wear of the bit body, an increase in the frictional restraint to rotation of the bit, and the necessity of increasing the weight-on-bit in order to continue drilling at the same rate of penetration.

International Patent Application No. WO 93/13290 (Dresser Industries Inc.) describes various drill bits of the above-mentioned kind, including arrangements where means are provided to assist removal of the tops of the ridges as drilling progresses.

The present invention relates to improved designs of rotary drill bit in which the above-mentioned disadvantages may be overcome.

SUMMARY OF THE INVENTION

According to the invention there is provided a rotary drilling tool comprising a tool body having a shank for connection to a drill string, a plurality of cutters mounted on the tool body and formed with cutting edges defining a cutting profile, the cutters including at least two concentric radially spaced arrays of primary preform polycrystalline diamond cutters where the cutters in each array are spaced circumferentially apart around the central axis of rotation of the tool and are so disposed radially as to define between primary cutting edges of the two arrays an annular groove in the cutting profile, the deepest portion of said groove in the cutting profile being defined by secondary cutting edges on secondary preform polycrystalline diamond cutters located at a radial distance from the tool axis which is intermediate the radial distances from said axis of the primary cutting edges in said two cutter arrays respectively.

Preferably said secondary cutting edges are of greater width, in a radial direction, than said annular groove in the cutting profile defined between said primary cutting edges.

In the above-mentioned arrangement proposed by Weaver and Clayton the deepest part of each annular groove in the cutting profile is defined by the tool body with the disadvantageous results previously referred to. According to the present invention, however, the deepest part of the groove in the cutting profile is at least partly defined by cutting edges of preform polycrystalline diamond cutters. Consequently, the upper free extremity of the or each annular ridge of formation formed during drilling is positively cut by the secondary cutting edges before it can engage the tool body. In view of this, the concentric arrays of cutters can be spaced more widely apart in the radial direction so that the annular ridge of formation can be much thicker in relation to its height. The arrangement may thus be such that the ridge does not break off as a result of lateral forces but remains whole all the time its upper edge is being cut or abraded. Thus, not only does the ridge of formation not abrade the tool body itself, but it is constantly in position to resist lateral displacement of the drilling tool and is unlikely to suffer premature breaking off which might otherwise allow lateral displacement to occur.

Each circular array of cutters may comprise a plurality of cutters of similar width located at substantially the same radial distance from the tool axis. Alternatively, each array may include a plurality of cutters located at different radial distances from the tool axis. In this case the radial width of the array is determined by the width of the total path swept by the combination of cutters in the array, during one revolution.

The secondary cutting edges may be provided on one or more secondary arrays of cutters located at least in part radially between the primary cutter arrays.

In the case where one or more secondary arrays of cutters are provided, each secondary array may also comprise cutters spaced circumferentially apart around the central axis of rotation of the drill bit and having cutting edges disposed at substantially the same radial distance from said axis. Again, each secondary array may comprise similar width cutters at the same radial distance from the bit axis, or cutters at different radial distances from the tool axis.

Preferably the aforesaid annular groove in the cutting profile is wholly defined by the cutting edges of the primary cutters and the cutting edges of the secondary cutters. For example, the sides of the groove may be defined by the cutting edges of the primary cutters in the first said arrays, and the bottom of the groove defined by the cutting edges of cutters in the secondary array or arrays.

In the latter case the cross-dimension of each secondary array of cutters, measured radially, is preferably greater than the radial spacing between the cutting edges of the primary cutters so that a cutting edge of each secondary cutter extends across the whole width of the annular groove in the cutting profile.

The secondary cutters may be substantially similar to the primary cutters. For example they may be in the form of circular or part-circular tablets.

At least some of the secondary cutters may be associated with a respective primary cutter, substantially all of said associated secondary cutters being circumferentially spaced by a substantially equal circumferential distance from their respective primary cutters. Each such associated secondary cutter may be spaced either frontwardly or rearwardly of the associated primary cutter with respect to the normal direction of rotation of the tool.

Back-up elements may be associated with at least some of the primary cutters, and/or at least some of the secondary cutters, each back-up element being located at substantially the same radial distance from the bit axis as its associated primary or secondary cutter but being spaced circumferentially therefrom, the back-up element being spaced inwardly of the portion of the cutting profile defined by its associated primary or secondary cutter.

The back-up element may be spaced forwardly or rearwardly of its associated primary or secondary cutter with respect to the normal direction of rotation of the drilling tool.

The back-up element may comprise a further cutter substantially similar to its associated primary or secondary cutter, or it may comprise an abrasion or depth stop element.

BRIEF DESCRIPTION OF THE DRAWINGS

FIG. 12 is a diagrammatic end view of another form of drill bit in accordance with the present invention, FIG. 13 is a sectional view showing the bottom hole pattern cut by a line of cutters in the drill bit of FIG. 12, FIG. 14 is a diagrammatic end view of a further of drill bit in accordance with the present invention, and FIG. 15 is a sectional view showing the bottom hole pattern cut by a line of cutters in the drill bit of FIG. 3.

DETAILED DESCRIPTION OF THE PREFERRED EMBODIMENTS

Figure 1:
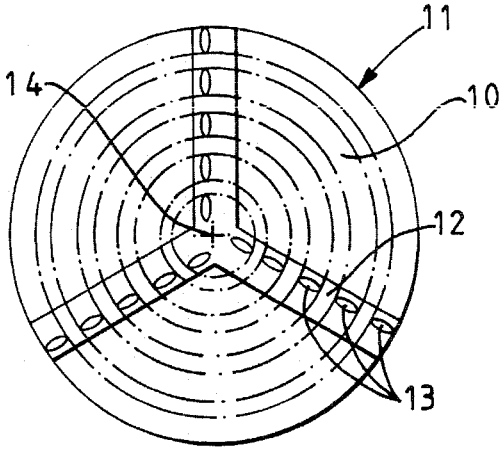
FIG 1 (Prior Art)
FIG. 1 is a diagrammatic end elevation of a prior art PDC drill bit designed to improve stabilisation while drilling.
Figure 2:
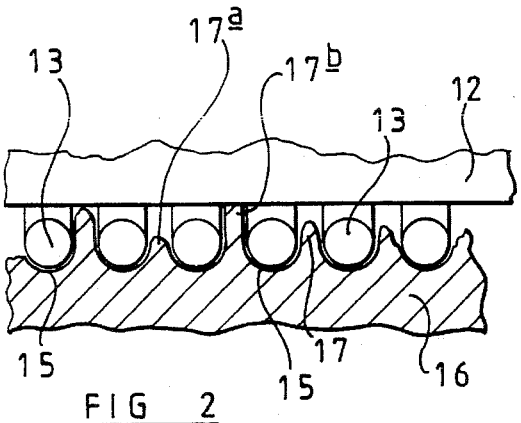
FIG 2 (Prior Art)
FIG. 2 is a diagrammatic section through a radial line of cutters in the drill bit of FIG. 1 showing part of the bottom hole pattern cut in the formation by the cutters.

Referring to the prior art arrangement shown in FIGS. 1 and 2, the end face 10 of the bit body 11 is formed with a number of blades 12, a series of PDC cutting elements 13 being spaced apart side-by-side in a generally radial direction along each blade. For the purposes of illustration, three such blades 12 are shown in FIG. 1 but it will be appreciated by those skilled in the art that any number of blades may be employed and the blades may carry different numbers of cutters.

In accordance with the principles previously mentioned, it has hitherto been the usual practice for the cutters 13 to be so located on their respective blades that the path swept out by each cutter overlaps the paths swept out by two or more other cutters which are located at slightly greater or lesser radial distances from the axis 14 of rotation of the bit. According to the prior art arrangement of FIGS. 1 and 2, however, the cutters are divided into a number of concentric radially spaced circular arrays of cutters, The cutters in each array are mounted on different blades 12 and are thus spaced circumferentially apart around the axis 14, the cutters in each circular array being disposed at substantially the same radial distance from the axis 14 so that all of the cutters in each circular array sweep out essentially the same circular path.

As a result, the cutting profile of the drill bit comprises a series of concentric annular grooves and, during drilling, as best seen in FIG. 2, each array of cutters 13 cuts an annular groove 15 in the formation 16, leaving an annular upstanding ridge 17 of formation between adjacent arrays of cutters. As previously described, the ribs 17 tend to inhibit lateral displacement of the drill bit during drilling.

However, the free upper extremities of the ribs 17 must eventually break off to allow further downward penetration of the cutters 13 into the formation 16. The point at which each rib breaks off may vary depending on the precise composition of the formation in the rib, its thickness, and the lateral force applied to the rib by the adjacent cutters. It will be appreciated of course that the spacing of the arrays of cutters must be sufficiently small so that the ribs 17 are sufficiently narrow in thickness to ensure that they eventually break off. As illustrated in FIG. 2 some ribs, such as indicated at 17*a*, may break off at a point where it no longer provides much lateral restraint to the bit. Other ribs, such as is indicated at 17*b*, may not break off until the rib has engaged the surface of the blade 12 or bit body on which the cutter is mounted so that the upper extremity of the rib must be worn away by the surface of the blade or bit body. This in turn will cause abrasive wear of the bit body, increase the frictional restraint to rotation of the bit, and necessitate an increase in the weight-on-bit in order to continue drilling at the same rate of penetration.

Figure 3:
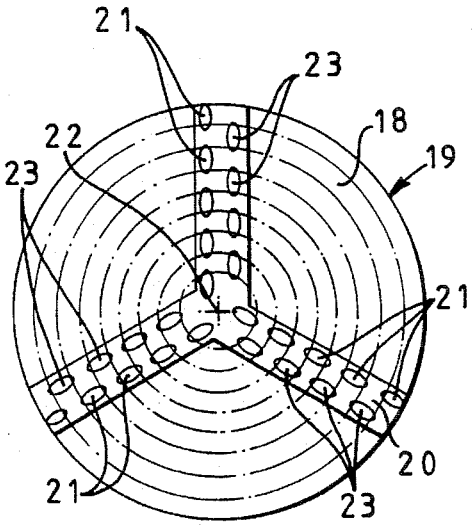
FIG. 3 is a diagrammatic end view of one form of drill bit in accordance with the present invention.
Figure 4:
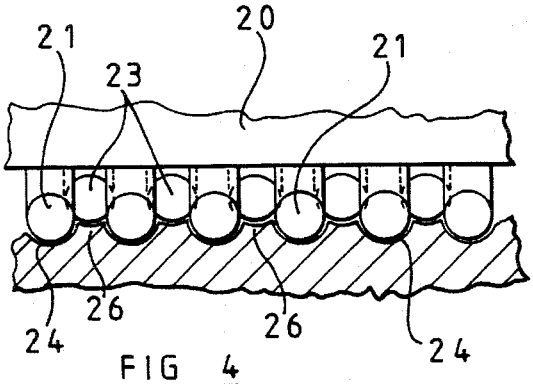
FIG. 4 is a sectional view showing the bottom hole pattern cut by a line of cutters in the drill bit of FIG. 3, FIGS. 5 and 6 are similar views to FIG. 4 showing alternative cutter configurations in accordance with the invention.

FIGS. 3 and 4 are similar views to FIG. 1 and 2 showing an arrangement according to the present invention. In this case, by way of example, the end face 18 of the bit body 19 is again formed with three generally radial blades 20 each of which carries a line of primary cutting elements 21 arranged side-by-side along the blade. As in the prior art arrangements the cutters 21 are arranged in a series of concentric arrays, the cutters in each circular array being disposed at substantially the same radial distance from the bit axis 22. In this case, however, there is also mounted on each blade 20 a line of secondary cutters 23. The secondary cutters 23 are also arranged in concentric circular arrays so that each secondary cutter on each blade 20 is at the same radial distance from the axis 22, and sweeps out the same circular path as the corresponding secondary cutter on each of the other two blades. However, the secondary cutters 23 are spaced from the axis 22 by radial distances which are intermediate the radial distances from the axis 22 of adjacent primary cutters 21, so that the circular path swept out by each secondary cutter 23 overlaps the circular paths swept out by two primary cutters 21 in adjacent circular arrays.

Each secondary cutter 23 is so mounted on the blade 20 that it is spaced inwardly from the parts of the cutting profile defined by the adjacent primary cutters 21.

As in the previous arrangement, during drilling each primary cutter 21 forms an annular groove 24 (see FIG. 4) in the formation 25 and due to the spacing of the arrays of primary cutters 21 this forms between each array an upstanding rib of formation as indicated at 26 in FIG. 4. Contrary to the arrangement of FIGS. 1 and 2, however, the upper extremity of each rib 26 is not required to break off to allow further penetration of the primary cutters 21 into the formation, but instead the upper extremity of each rib is positively cut away by the cutting edge of a secondary cutter 23. This has two important advantages when compared with the prior art arrangement.

Firstly, since the upper extremity of each rib 26 is always positively cut away by a secondary cutter 23, there is no possibility of it rubbing on the surface of the blade 20 or bit body to cause abrasive wear and frictional restraint to rotation of the drill bit. Secondly, since the upper extremity of each rib 26 is always positively cut away, it is not necessary for the ribs 26 to be sufficiently thin to ensure that they break off eventually. Consequently, the spacing of adjacent arrays of primary cutters 21 can be greater to form a thicker rib 26 which will then provide far stronger and more consistent restraint to lateral displacement of the bit than is possible with the thin ribs 17 of the arrangement of FIGS. 1 and 2.

Although FIGS. 3 and 4 show only a single secondary cutter overlapping the paths swept out by two primary cutters 21 in adjacent circular arrays, each secondary cutter 23 might be replaced by two or more secondary cutters, the secondary cutters being at different radial distances from the axis 22 so that the paths swept out by the secondary cutters overlap each other as well as the overlapping paths swept out by the associated primary cutters 21. Such an arrangement is shown in FIGS. 12 and 13, where the primary cutters are referenced 63 and the secondary cutters are referenced 64.

Similarly, each single primary cutter 21 might be replaced by two or more circumferentially spaced primary cutters which are at different radial distances from the axis 22 so that the paths they sweep out during rotation overlap. The radial width of each primary array is then equal to the overall width of the overlapping paths of the individual primary cutters. Such an arrangement is shown in FIGS. 14 and 15 where the primary cutters are referenced 65 and the secondary cutters are referenced 66.

Although in the arrangements of FIGS. 3 and 4 the secondary cutters 23 are shown as the same diameter as the primary cutters 21 they could be larger or smaller or of different shape. Although the secondary cutters 23 are shown as being located in concentric radially spaced arrays, in similar fashion to the primary cutters 21, this is also not essential and the secondary cutters could be distributed in any fashion over the face of the drill bit provided that their contribution to the overall cutting profile is to define the deepest parts of the annular grooves in the cutting profile which form the ribs 26.

Figure 5:
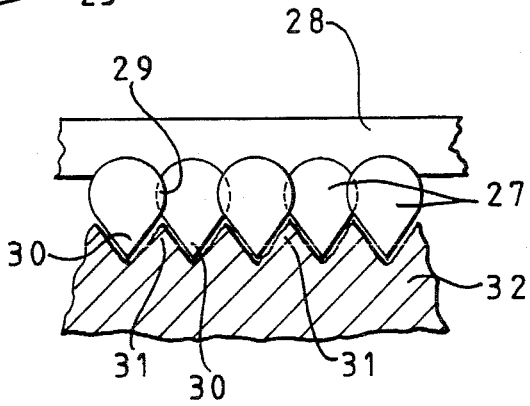

Instead of the secondary cutting edges which remove the tops of the ribs 26 being provided by separate secondary cutters 23, the primary cutters themselves may be so shaped as to provide the secondary cutting edges. FIG. 5 shows such an arrangement.

In the arrangement of FIG. 5 the primary cutters 27 are again located in concentric circular arrays so that all the cutters in each array sweep out the same path. In this case, however, the cutters 27 are shaped so as to taper inwardly as they extend away from the bit body or blade 28 and are so located radially of the bit that the wider portions 29 of the cutters have overlapping paths and the narrower portions 30 of the cutters are spaced apart. (It will be appreciated that the cutters 27 will have to be circumferentially, as well as radially spaced, to allow their paths to overlap as shown.) Again, therefore, the cutting profile defined by the cutters 27 comprises a number of concentric annular grooves resulting in the formation, during drilling, of annular upstanding ribs 31 in the formation 32 being drilled. In this case as drilling proceeds the upper edges of the ribs 31 are constantly being removed by the secondary cutting edges provided by the wider portions 29 of the cutters 27.

Figure 6:
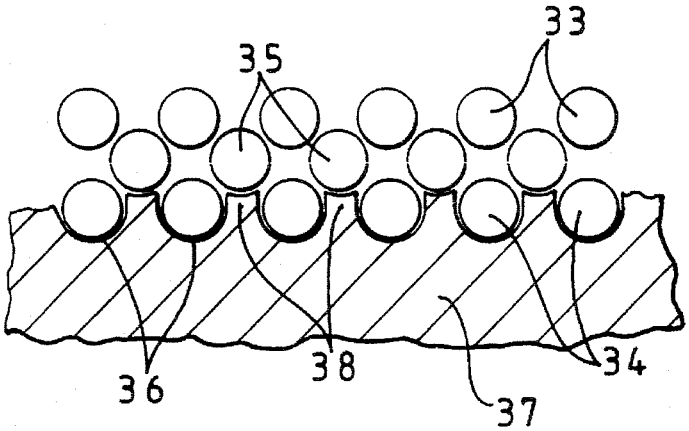

FIG. 6 shows an arrangement in which there are provided concentric arrays of tertiary cutters 33 in addition to arrays of primary cutters 34 and secondary cutters 35. In this case the tertiary cutters 33 are located even further away from the formation than the secondary cutters 35 and both the secondary cutters 35 and tertiary cutters 33 are arranged in concentric radially spaced arrays. As drilling proceeds the primary cutters 34 form concentric annular grooves 36 in the formation 37 to form annular ribs 38. The free extremities of the annular ribs 38 are positively cut away by the secondary cutters 35 in similar manner to that described in relation to FIG. 4. In this case, however, if drilling continues until the primary cutters 34 are totally worn away, the secondary cutters 35 will take over as the primary cutters of the formation. Since the secondary cutters 35 are also located in concentric spaced arrays, they too will form annular grooves in the formation separated by upstanding annular ribs of formation which will extend between the adjacent arrays of secondary cutters 35 and have their free extremities positively cut away by the tertiary cutters 33. Further rows of cutters may be provided, if required.

Although, for purposes of illustration in FIGS. 3, 4 and 6, the primary cutters in the different circular arrays are shown as being mounted side-by-side along a generally radial line, this is not essential to the invention and the primary cutters in different circular arrays could equally well be circumferentially spaced from one another around the bit, provided that the cutters in each array maintain the same radial distance from the axis of rotation of the bit. The same applies to the secondary cutters.

Figure 7:
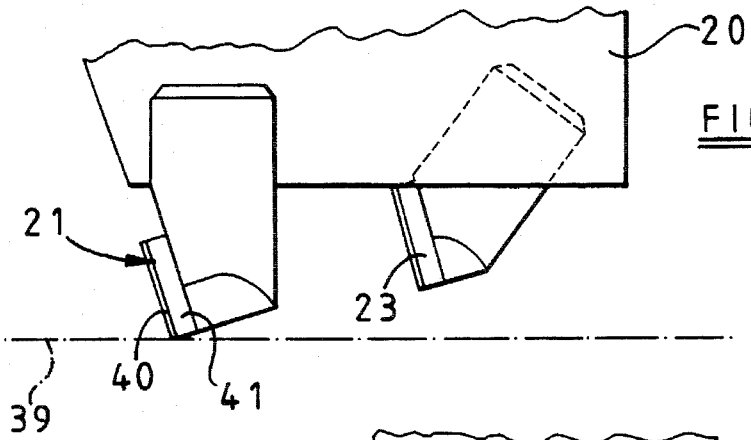
FIG. 7 is a diagrammatic section taken along a circumference of a drill bit showing one arrangement of the primary and secondary cutters.

FIG. 7 is a circumferential section through part of one of the blades 20 of the arrangement of FIG. 3 and shows a typical arrangement whereby a secondary cutter 23 may be mounted inwardly of the part of the cutter profile (shown dotted at 39) defined by an associated primary cutter 21. In each case the cutting element 21 or 23 is a PDC cutter comprising a thin cutting table of polycrystalline diamond 40 bonded in a high pressure, high temperature press to a substrate 41 of hard material such as tungsten carbide. The cutter 21 is brazed to a suitably inclined surface on a stud or post received in a socket in the blade 20.

Figure 8:
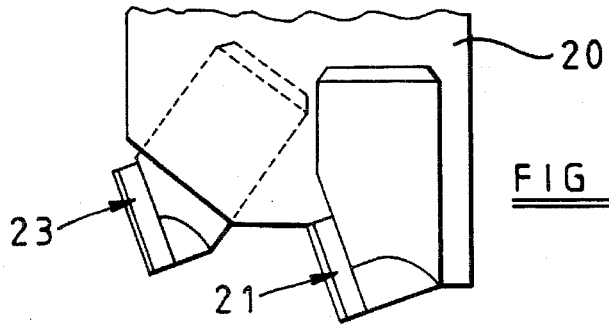
FIG. 8 is a similar view to FIG. 7 showing an alternative arrangement of primary and secondary cutters.

In the arrangement of FIGS. 3 and 7 the secondary cutters 23 follow the primary cutters 21 on the blade 20 with respect to the normal direction of rotation of the drill bit. However, according to another aspect of the present invention, there may be advantage in reversing this arrangement, as shown in FIG. 8, so that each secondary cutter 23 is mounted on the blade 20 so as to be ahead of the associated primary cutters 21 with respect to the normal direction of rotation. Thus, the arrangement of FIGS. 3 and 7 may suffer from the disadvantage that the primary cutters 21, since they project further from the bit body than the secondary cutters 23, may prevent adequate flow of drilling fluid to the secondary cutters. Consequently, there may be inadequate cleaning and cooling of the secondary cutters leading to their deterioration and eventual ineffectiveness. Due to inadequate cleaning, there may also be "bailing" of formation cuttings around the secondary cutters 23, leading to a reduction in their effectiveness.

In the arrangement of FIG. 8, on the other hand, the cutting elements 23, being on the leading side of the blade 20, will be exposed to the full cooling and cleaning action of the drilling fluid. At the same time, since the primary cutters 21 project further from the bit body than the secondary cutters 23 they too will receive an adequate flow of drilling fluid for purposes of cleaning and cooling.

In the arrangement of FIG. 8 it may be desirable to provide increased relief behind each primary cutter 21 to reduce the area of wear flat which develops behind the cutting edge as the cutter wears down.

Figure 9:
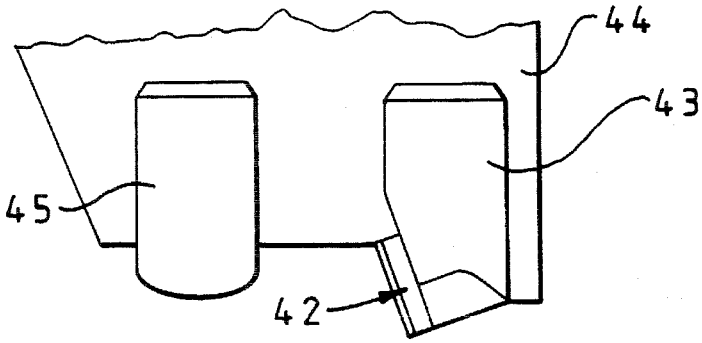
FIG. 9 is a similar view showing a primary cutter with a back-up element.

In order to increase the resistance of the drill bit to displacement by lateral forces, there may be associated with at least certain of the primary cutting elements back-up elements which are arranged at the same radial distance as each primary cutting element so as to enter the groove cut in the formation by the primary cutting element. FIG. 9 shows such an arrangement. In this case the primary cutting element 42 is again mounted on a post 43 received in a socket in the blade 44 on the bit body and there is also mounted in a socket in the blade 44 an abrasion element 45 which is located at the same radius from the axis of the bit as the cutting element 42.

The abrasion element 45 may be in the form of a tungsten carbide stud which may have natural or synthetic diamond embedded therein. Preferably the abrasion element 45 is of essentially the same width as the cutting element 42, as measured in a radial direction, so that it generally fits within the groove cut in the formation by the cutting element 42. Preferably, however, the abrasion element 45 extends away from the bit body to a lesser extent than the cutting element 42 so that during normal drilling it does not bear on the bottom of the groove cut by the cutting element 42.

The abrasion element 45, in addition to providing restraint against lateral forces on the drill bit, also serves as a depth stop to limit the extent of penetration of the primary cutter 42 into the formation, and may also serve as a back-up cutter should the cutter 42, or indeed any other primary cutter at the same radius, suffer catastrophic failure.

Although in FIGS. 7–9 the secondary cutters and back-up elements are each sown as being mounted on the same blade as the respective associated primary cutter, it will be appreciated that the secondary cutter or back-up element might also be mounted on a different blade from its associated primary cutter.

In the arrangement of FIG. 9 the abrasion element 45 is shown on the leading side of the primary cutter 42, and this gives the cooling and cleaning advantages described above in relation to the arrangement of FIG. 8. However, it will be appreciated that the abrasion element might also be located rearwardly of the primary cutter 42 with respect to the normal direction of rotation of the bit.

The arrangements of FIGS. 8 and 9, where a secondary cutter or abrasion element is located on the leading side of the primary cutter, is particularly applicable to the present invention where the primary cutters are arranged in concentric circular arrays with the advantages given thereby, as previously discussed. However, it will be appreciated by those skilled in the art that placing a secondary cutter or abrasion element on the leading side, instead of the trailing side, of an associated primary cutter may also have advantage in other forms of PDC drill bit since the advantages of adequate cleaning and cooling will apply regardless of the arrangement of the primary cutters on the bit body.

In the arrangement of FIG. 9 the composition of the back-up elements 45 may be varied according to their location on the drill bit. For example, the composition of the back-up elements at the nose of the bit may be selected to give good wear resistance, whereas elements at the gauge of the bit may be formed from a composition selected to give greater impact resistance.

Figure 10:
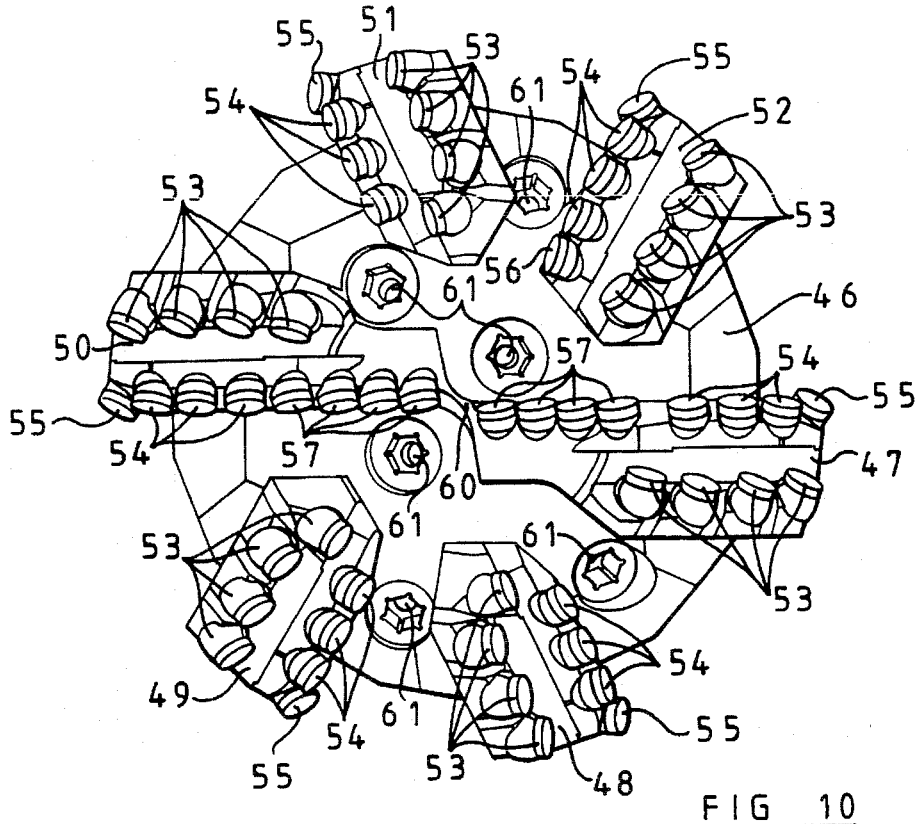
FIG. 10 is a diagrammatic end view of a further form of drill bit in accordance with the invention.
Figure 11:
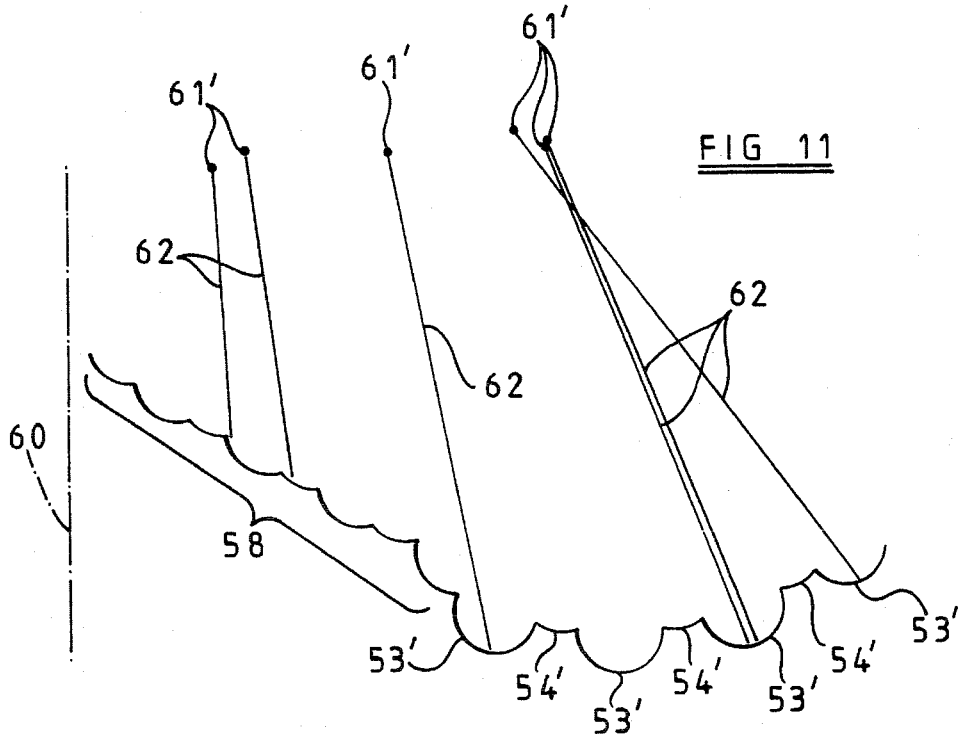
FIG. 11 is a diagrammatic sectional representation of the cutting pattern of a line of cutters in the drill bit of FIG. 10.

FIG. 10 shows in greater detail a typical drill bit designed according to the present invention and FIG. 11 shows diagrammatically one half of the bottom hole pattern cut by the drill bit of FIG. 10.

Referring to FIG. 10, the bit body 46 is formed with six blades 47–52. Each blade has mounted thereon four primary cutters 53 extending side-by-side along the blade from the outer extremity thereof. Corresponding primary cutters 53 on each blade are disposed at the same radial distance from the central axis of rotation 60 of the bit so as to provide four concentric radially spaced circular arrays of cutters, each array comprising six circumferentially spaced primary cutters 53.

Each blade also carries, spaced in front of the four primary cutters 53, three secondary cutters 54 which are set closer to the bit body than the primary cutters 53, the arrangement being similar to that shown in FIG. 8.

The secondary cutters 54 are arranged in three concentric circular arrays, each array again comprising six circumferentially spaced cutters 54 arranged at the same radial distance from the axis 60. The radial distance of each array of secondary cutters from the axis 60 is intermediate the radial distances from the axis of the two adjacent circular arrays of primary cutters.

FIG. 11 shows one half of the cutting profile defined by the cutters on the bit. The portions of the profile defined by the four circular arrays of primary cutters 53 are indicated at 53' and the portions defined by the three circular arrays of secondary cutters 54 are indicated at 54'. The cutters therefore act on the formation in similar manner-to that shown in FIG. 4 so as to form upstanding concentric annular ribs in the formation around the outer portion of the bottom of the borehole.

All of the blades of the drill bit carry a further cutter 55 spaced radially outwardly of the secondary cutters. In addition blade 52 carries a single further cutter 56 spaced radially inwardly of the secondary cutters 54 on that blade, and blades 47 and 50 each carry four further cutters 57 spaced side-by-side along the blade radially inwardly of the secondary cutters 54. The cutters 56 and 57 are disposed at various radial distances from the axis 60 and are not grouped in concentric spaced circular arrays as is the case with the primary and secondary cutters. The paths swept out by the cutters 56 and 57 therefore overlap in more conventional manner to provide a cutting profile as indicated generally at 58 in FIG. 11.

An arrangement according to the invention, and generally of the kind shown in FIGS. 10 and 11, allows the production of a heavy-set drill bit without necessarily requiring an increase in the number of blades on which the cutters are mounted. In certain circumstances it is considered desirable to keep the number of blades to a minimum to reduce the possibility of "bailing".

In conventional manner, the end surface of the bit body, between the blades, is formed with a number of nozzles 61 (six in the arrangement of FIG. 10) which deliver drilling fluid to the surface of the bit from an internal passage for the purpose of cooling and cleaning the cutters. In arrangements according to the present invention it may be advantageous for at least some of the nozzles to be so located and orientated that the jets of drilling fluid emerging from the nozzles impinge on the formation within one or more of the annular grooves formed by the primary cutters. The drilling fluid will then tend to flow along the grooves to reach not only the primary cutters which are cutting the grooves, but also the associated secondary cutters. The grooves in the formation thus serve to distribute the drilling fluid over the face of the drill bit.

In FIG. 11 the nozzles are indicated diagrammatically at 61' and the lines 62 indicate the direction of the centreline of the jet of fluid which emerges from each nozzle.

In the above embodiments the invention has been described as applied to a drill bit for drilling a new hole in subsurface formations. However, as previously mentioned, the invention is also applicable to drilling tools of other types, such as hole openers and eccentric hole openers.

I claim:

1. A rotary drilling tool comprising a tool body having a shank for connection to a drill string, a plurality of cutters mounted on the tool body and formed with cutting edges defining a cutting profile, the cutters including at least two concentric radially spaced arrays of primary preform polycrystalline diamond cutters where the cutters in each array are spaced circumferentially apart around the central axis of rotation of the tool and are so disposed radially as to define between primary cutting edges of the two arrays an annular groove in the cutting profile, the deepest portion of said groove in the cutting profile being defined by secondary cutting edges on secondary preform polycrystalline diamond cutters located at a radial distance from the tool axis which is intermediate the radial distances from said axis of the primary cutting edges in said two cutter arrays respectively, and wherein each array includes a plurality of cutters located at different radial distances from the tool axis, the radial width of the array being determined by the width of the total path swept by the combination of cutters in the array, during one revolution.

2. A rotary drilling tool comprising a tool body having a shank for connection to a drill string, a plurality of cutters mounted on the tool body and formed with cutting edges defining a cutting profile, the cutters including at least two concentric radially spaced arrays of primary preform polycrystalline diamond cutters where the cutters in each array are spaced circumferentially apart around the central axis of rotation of the tool and are so disposed radially as to define between primary cutting edges of the two arrays an annular groove in the cutting profile, the deepest portion of said groove in the cutting profile being defined by secondary cutting edges on secondary preform polycrystalline diamond cutters located at a radial distance from the tool axis which is intermediate the radial distances from said axis of the primary cutting edges in said two cutter arrays respectively, wherein the secondary cutting edges are provided on at least one secondary array of cutters located at least in part radially between the primary cutter arrays, said secondary array comprising similar width cutters spaced circumferentially apart around the central axis of rotation of the drill bit and having cutting edges disposed at different radial distances from said axis, the radial width of the array being determined by the width of the total path swept by the combination of cutters in the array, during one revolution.

* * * * *